US012781727B2

(12) United States Patent
Blendea et al.

(10) Patent No.: US 12,781,727 B2
(45) Date of Patent: Nov. 3, 2026

(54) PUMP DIAPHRAGM WITH IMPROVED SEAL GEOMETRY

(71) Applicant: Leggett & Platt Canada Co., Halifax (CA)

(72) Inventors: Horia Blendea, LaSalle (CA); Paul Tindall, Harrow (CA)

(73) Assignee: Leggett & Platt Canada Co., Halifax (CA)

( * ) Notice: Subject to any disclaimer, the term of this patent is extended or adjusted under 35 U.S.C. 154(b) by 193 days.

(21) Appl. No.: 18/525,491

(22) Filed: Nov. 30, 2023

(65) Prior Publication Data

US 2025/0180003 A1 Jun. 5, 2025

(51) Int. Cl.

| | |
|---|---|
| ***F04B 43/02*** | (2006.01) |
| ***F04B 43/00*** | (2006.01) |
| ***F04B 43/04*** | (2006.01) |
| ***F04B 45/04*** | (2006.01) |

(52) U.S. Cl.

CPC ..... *F04B 43/026* (2013.01); *F04B 43/0054* (2013.01); *F04B 43/02* (2013.01); *F04B 43/04* (2013.01); *F04B 45/04* (2013.01); *F04B 45/043* (2013.01)

(58) Field of Classification Search

CPC .... F04B 43/026; F04B 43/0054; F04B 43/04; F04B 45/047; F04B 45/043; F04B 45/04; F04B 43/02

See application file for complete search history.

(56) References Cited

U.S. PATENT DOCUMENTS

| | | | |
|---|---|---|---|
| 3,199,774 | A | 8/1965 | Lowell |
| 3,203,447 | A | 8/1965 | Bremner et al. |
| 3,442,483 | A | 5/1969 | Schwartz |
| 4,115,039 | A | 9/1978 | Schjelde et al. |
| 4,529,214 | A | 7/1985 | Stoll et al. |

(Continued)

FOREIGN PATENT DOCUMENTS

| | | | |
|---|---|---|---|
| CN | 2526615 | Y | 12/2002 |
| CN | 103991396 | A | 8/2014 |

(Continued)

OTHER PUBLICATIONS

International Search Report and Written Opinion for Application No. PCT/CA2024/051578 dated Feb. 12, 2025 (14 pages).

(Continued)

*Primary Examiner* — Peter J Bertheaud

(74) *Attorney, Agent, or Firm* — Michael Best & Friedrich LLP

(57) ABSTRACT

A diaphragm for use with a pump assembly includes a flange, a cup-shaped wall extending from the flange and defining an interior volume having an opening, a plunger extending from the cup-shaped wall, the plunger configured to be reciprocated by the pump assembly to move the cup-shaped wall, thereby cyclically compressing and expanding the interior volume, and a seal extending from the flange such that the seal surrounds the opening, the seal including an outer sealing surface configured to engage a portion of the pump assembly. The outer sealing surface extends from the flange at an oblique angle such that the outer sealing surface converges from the flange toward a center of the opening.

20 Claims, 8 Drawing Sheets

(56) References Cited

U.S. PATENT DOCUMENTS

| | | | | |
|---|---|---|---|---|
| 4,548,041 | A | 10/1985 | Taylor | |
| 4,630,799 | A | 12/1986 | Nolan et al. | |
| 4,674,398 | A | 6/1987 | Taylor | |
| 4,697,612 | A | 10/1987 | Kleineberg et al. | |
| 4,903,732 | A | 2/1990 | Allen | |
| 4,922,965 | A | 5/1990 | Meister | |
| 4,973,024 | A | 11/1990 | Homma | |
| 5,148,833 | A | 9/1992 | Ota | |
| 5,211,371 | A | 5/1993 | Coffee | |
| 5,791,882 | A * | 8/1998 | Stucker | F04B 43/0045 417/269 |
| 6,098,000 | A | 8/2000 | Long et al. | |
| 6,132,183 | A | 10/2000 | Li et al. | |
| 6,135,726 | A | 10/2000 | Robertson et al. | |
| 6,203,105 | B1 | 3/2001 | Rhodes, Jr. | |
| 6,499,509 | B2 | 12/2002 | Berger et al. | |
| 7,040,876 | B2 * | 5/2006 | Fukami | F04B 43/026 417/413.1 |
| 7,331,773 | B2 | 2/2008 | Nawa | |
| 7,744,059 | B2 | 6/2010 | Jerg | |
| 7,815,161 | B2 | 10/2010 | Saitoh et al. | |
| 8,499,779 | B2 | 8/2013 | Gillespie | |
| 8,629,745 | B2 | 1/2014 | Sturman et al. | |
| 8,784,080 | B2 | 7/2014 | Dorfler et al. | |
| 8,794,707 | B2 | 8/2014 | Bocsanyi et al. | |
| 9,186,853 | B2 | 11/2015 | Khan et al. | |
| 9,797,521 | B1 | 10/2017 | Davis | |
| 9,945,490 | B2 | 4/2018 | Dankbaar et al. | |
| 9,951,765 | B2 | 4/2018 | Ki et al. | |
| 10,066,756 | B2 | 9/2018 | Sohn | |
| 10,107,279 | B2 | 10/2018 | Dankbaar et al. | |
| 10,107,410 | B2 | 10/2018 | Dankbaar et al. | |
| 10,207,619 | B2 | 2/2019 | Dankbaar et al. | |
| 10,290,876 | B2 | 5/2019 | Prieto et al. | |
| 10,378,677 | B2 | 8/2019 | Kuszneruk et al. | |
| 10,753,494 | B2 | 8/2020 | Beuschel et al. | |
| 10,948,097 | B2 | 3/2021 | Dorfler et al. | |
| 11,073,219 | B2 | 7/2021 | Dorfler et al. | |
| 11,287,456 | B2 | 3/2022 | Wang et al. | |
| 11,422,169 | B2 | 8/2022 | Ferraro et al. | |
| 2002/0112788 | A1 | 8/2002 | Tanaka et al. | |
| 2003/0178074 | A1 | 9/2003 | Itzhaky | |
| 2005/0005980 | A1 | 1/2005 | Eberhardt et al. | |
| 2005/0053487 | A1 | 3/2005 | Munker et al. | |
| 2005/0139610 | A1 | 6/2005 | Crossdale et al. | |
| 2006/0034707 | A1 | 2/2006 | Thomas et al. | |
| 2006/0034708 | A1 | 2/2006 | Thomas et al. | |
| 2007/0023089 | A1 | 2/2007 | Beyerlein et al. | |
| 2007/0140879 | A1 | 6/2007 | Huang | |
| 2007/0237653 | A1 | 10/2007 | Wang | |
| 2007/0237654 | A1 | 10/2007 | Kasuya et al. | |
| 2008/0271559 | A1 | 11/2008 | Garscha et al. | |
| 2010/0139785 | A1 | 6/2010 | Saitoh et al. | |
| 2010/0226805 | A1 | 9/2010 | Kulmer | |
| 2011/0095216 | A1 | 4/2011 | Degreef et al. | |
| 2012/0067430 | A1 | 3/2012 | Deperraz et al. | |
| 2012/0143108 | A1 | 6/2012 | Bocsanyi et al. | |
| 2012/0153043 | A1 | 6/2012 | Arekar et al. | |
| 2012/0199768 | A1 | 8/2012 | Love et al. | |
| 2013/0064689 | A1 | 3/2013 | White et al. | |
| 2014/0103232 | A1 | 4/2014 | Deperraz | |
| 2014/0232155 | A1 | 8/2014 | Bocsanyi et al. | |
| 2015/0028234 | A1 | 1/2015 | Kraus et al. | |
| 2016/0018016 | A1 | 1/2016 | Dankbaar et al. | |
| 2016/0153575 | A1 | 6/2016 | Sohn | |
| 2016/0207075 | A1 | 7/2016 | Alexander et al. | |
| 2017/0298913 | A1 | 10/2017 | Kim et al. | |
| 2018/0023906 | A1 | 1/2018 | Tajiri et al. | |
| 2018/0038514 | A1 | 2/2018 | Kusneruk et al. | |
| 2018/0119686 | A1 | 5/2018 | Shakal et al. | |
| 2018/0135615 | A1 | 5/2018 | Snyder et al. | |
| 2018/0283571 | A1 | 10/2018 | Miyazoe et al. | |
| 2018/0306212 | A1 | 10/2018 | Weickel et al. | |
| 2018/0363642 | A1 | 12/2018 | Salih et al. | |
| 2019/0003609 | A1 | 1/2019 | Asai et al. | |
| 2019/0107214 | A1 | 4/2019 | Kruppe et al. | |
| 2019/0116681 | A1 | 4/2019 | De Carolis et al. | |
| 2019/0118690 | A1 | 4/2019 | Beuschel et al. | |
| 2019/0120402 | A1 | 4/2019 | Jamison et al. | |
| 2019/0195246 | A1 | 6/2019 | Jamison et al. | |
| 2019/0353268 | A1 | 11/2019 | Dorfler et al. | |
| 2019/0353270 | A1 | 11/2019 | Dorfler et al. | |
| 2020/0088314 | A1 | 3/2020 | Samain et al. | |
| 2020/0378527 | A1 | 12/2020 | Stephan et al. | |
| 2021/0018109 | A1 | 1/2021 | Beuschel et al. | |
| 2022/0106955 | A1 | 4/2022 | Auernhammer et al. | |
| 2022/0205551 | A1 | 6/2022 | Nicola et al. | |
| 2022/0243827 | A1 | 8/2022 | Nicola et al. | |
| 2022/0260073 | A1 | 8/2022 | Blendea et al. | |
| 2022/0372969 | A1 | 11/2022 | Hines | |

FOREIGN PATENT DOCUMENTS

| | | | |
|---|---|---|---|
| CN | 105465090 | A | 4/2016 |
| CN | 108953683 | A | 12/2018 |
| CN | 109318770 | A | 2/2019 |
| CN | 110030180 | A | 7/2019 |
| DE | 19545011 | A1 | 4/1997 |
| DE | 19718169 | A1 | 11/1998 |
| DE | 10063478 | A1 | 7/2002 |
| DE | 102005060217 | A1 | 7/2006 |
| DE | 102006053147 | A1 | 5/2007 |
| DE | 102011100327 | B3 | 8/2012 |
| DE | 102013208820 | A1 | 11/2014 |
| DE | 202014006875 | U1 | 12/2014 |
| DE | 102015201534 | B3 | 4/2016 |
| DE | 102014225756 | A1 | 6/2016 |
| DE | 102016225519 | A1 | 6/2018 |
| DE | 102017204662 | B3 | 7/2018 |
| DE | 102017107073 | A1 | 10/2018 |
| DE | 102017217213 | B3 | 3/2019 |
| DE | 102018200635 | A1 | 7/2019 |
| DE | 202020107139 | U1 | 3/2021 |
| EP | 0423045 | A1 | 4/1991 |
| EP | 1619287 | A1 | 1/2006 |
| EP | 1909008 | A1 | 4/2008 |
| EP | 1988440 | A1 | 11/2008 |
| EP | 2078891 | A2 | 7/2009 |
| EP | 2740521 | A1 | 6/2014 |
| EP | 2860401 | A2 | 4/2015 |
| EP | 3343078 | A1 | 7/2018 |
| GB | 830393 | A | 3/1960 |
| GB | 830394 | A | 3/1960 |
| GB | 971816 | A | 10/1964 |
| JP | 4091035 | B2 | 5/2008 |
| WO | 2004104462 | A1 | 12/2004 |
| WO | 2009015528 | A1 | 2/2009 |
| WO | 2012159689 | A1 | 11/2012 |
| WO | 2014135909 | A1 | 9/2014 |
| WO | 2015185132 | A | 12/2015 |
| WO | 2018005528 | A1 | 1/2018 |
| WO | 2018049526 | A1 | 3/2018 |
| WO | 2018065217 | A1 | 4/2018 |
| WO | 2019124131 | A1 | 6/2019 |
| WO | 2019149498 | A1 | 8/2019 |
| WO | 2019207451 | A2 | 10/2019 |
| WO | 2019218072 | A1 | 11/2019 |

OTHER PUBLICATIONS

G.RAU Innovative Metalle, "Thermal Actuators", 12 pages, retrieved Apr. 7, 2019.

* cited by examiner

PUMP DIAPHRAGM WITH IMPROVED SEAL GEOMETRY

BACKGROUND

The present disclosure relates to a diaphragm for a pump and, more specifically, to a seal configuration for a compression chamber of the diaphragm.

SUMMARY

In some aspects, the techniques described herein relate to a diaphragm for use with a pump assembly, the diaphragm including: a flange; a cup-shaped wall extending from the flange and defining an interior volume having an opening; a plunger extending from the cup-shaped wall, the plunger configured to be reciprocated by the pump assembly to move the cup-shaped wall, thereby cyclically compressing and expanding the interior volume; and a seal extending from an upper surface of the flange such that the seal surrounds the opening, the seal including an outer sealing surface configured to engage a portion of the pump assembly, wherein the outer sealing surface extends from the flange at an oblique angle such that the outer sealing surface is inclined from the upper surface of the flange toward a center of the opening.

In some aspects, the techniques described herein relate to a diaphragm, wherein the diaphragm is integrally formed as a single, molded component.

In some aspects, the techniques described herein relate to a diaphragm, wherein the seal is an outer seal, the diaphragm further including an inner seal extending from the flange and spaced radially inwardly from the inner seal.

In some aspects, the techniques described herein relate to a diaphragm, further including a recess extending into the flange radially inwardly of the seal.

In some aspects, the techniques described herein relate to a diaphragm, wherein the inner seal has a first cross-sectional shape, and wherein the outer seal has a second cross-sectional shape that is different than the first cross-sectional shape.

In some aspects, the techniques described herein relate to a diaphragm, wherein the outer seal is configured to withstand a greater pressure than the inner seal.

In some aspects, the techniques described herein relate to a pump assembly including: a diaphragm including a wall defining an interior volume having an opening, a plunger coupled to the wall, an inner seal extending around a perimeter of the opening, and an outer seal surrounding and spaced apart from the inner seal; a plate coupled to the diaphragm opposite the plunger; and a drive mechanism configured to reciprocate the plunger to perform cycles of compressing and expanding the interior volume, wherein the inner seal and the outer seal engage the plate to inhibit air from entering or escaping the interior volume through an interface between the diaphragm and the plate.

In some aspects, the techniques described herein relate to a pump assembly, further including a recess formed between the inner seal and the outer seal.

In some aspects, the techniques described herein relate to a pump assembly, wherein the inner seal tapers in a direction from the diaphragm towards the plate.

In some aspects, the techniques described herein relate to a pump assembly, wherein the outer seal tapers in a direction from the diaphragm towards the plate.

In some aspects, the techniques described herein relate to a pump assembly, wherein the inner seal has a first cross-sectional shape, and wherein the outer seal has a second cross-sectional shape that is different than the first cross-sectional shape.

In some aspects, the techniques described herein relate to a pump assembly, wherein the diaphragm is a first diaphragm of a plurality of diaphragms.

In some aspects, the techniques described herein relate to a pump assembly, wherein the inner seal is more flexible than the outer seal.

In some aspects, the techniques described herein relate to a pump assembly, wherein the inner seal has an inner wall and an outer wall, wherein the inner wall is parallel to an axis of reciprocation of the plunger, and wherein the outer wall is sloped relative to the inner wall.

In some aspects, the techniques described herein relate to a pump, wherein the outer seal has an inner wall and an outer wall, wherein the inner wall is parallel to an axis of reciprocation of the plunger, and wherein the outer wall is sloped towards the inner wall.

In some aspects, the techniques described herein relate to a pump assembly including: a diaphragm assembly including a plurality of diaphragms, each diaphragm of the plurality of diaphragms including: a wall defining an interior volume having an opening, a plunger coupled to the wall, an inner seal extending around a perimeter of the opening, and an outer seal surrounding and spaced apart from the inner seal; a plate coupled to the diaphragm assembly; and a drive mechanism configured to reciprocate the plunger of each diaphragm of the plurality of diaphragms to perform cycles of compressing and expanding the interior volume, wherein the inner seal and the outer seal of each diaphragm of the plurality of diaphragms engage the plate to inhibit air from entering or escaping the interior volume through an interface between the diaphragm and the plate.

In some aspects, the techniques described herein relate to a pump assembly, wherein the diaphragm assembly is integrally molded as a single component.

In some aspects, the techniques described herein relate to a pump assembly, wherein the drive mechanism is configured to reciprocate each diaphragm of the plurality of diaphragms sequentially.

In some aspects, the techniques described herein relate to a pump assembly, wherein the inner seal has a first cross-sectional shape, and wherein the outer seal has a second cross-sectional shape that is different than the first cross-sectional shape.

In some aspects, the techniques described herein relate to a pump assembly, wherein the inner seal and the outer seal each include an obliquely oriented outer surface.

Other aspects of the disclosure will become apparent by consideration of the detailed description and accompanying drawings.

Before any embodiments of the disclosure are explained in detail, it is to be understood that the disclosure is not limited in its application to the details of construction and the arrangement of components set forth in the following description or illustrated in the following drawings. The disclosure is capable of supporting other embodiments and of being practiced or of being carried out in various ways. Also, it is to be understood that the phraseology and terminology used herein is for the purpose of description and should not be regarded as limiting. In addition, as used herein, the terms "upper", "lower", and other directional terms are not intended to require any particular orientation but are instead used for purposes of description only.

DETAILED DESCRIPTION

Pneumatic pump assemblies, as will be described in further detail herein, may utilize a diaphragm that is movable to generate an air flow. The diaphragm includes a seal to prevent air from leaking out of the pump assembly, which would decrease the effectiveness of the pump assembly. However, typical seal designs (i.e., beads) do not account for thermal expansion that the pneumatic pump assembly may experience during operation. Typical seal designs also do not account for dimensional deviations of components of the pump assembly. Such seal designs, therefore, may not effectively seal the pump assembly to prevent air from leaking out of the pump assembly during use. The present disclosure provides a seal capable of accommodating for thermal expansion and dimensional deviations of components of the pump assembly, among other things.

Figure 1:
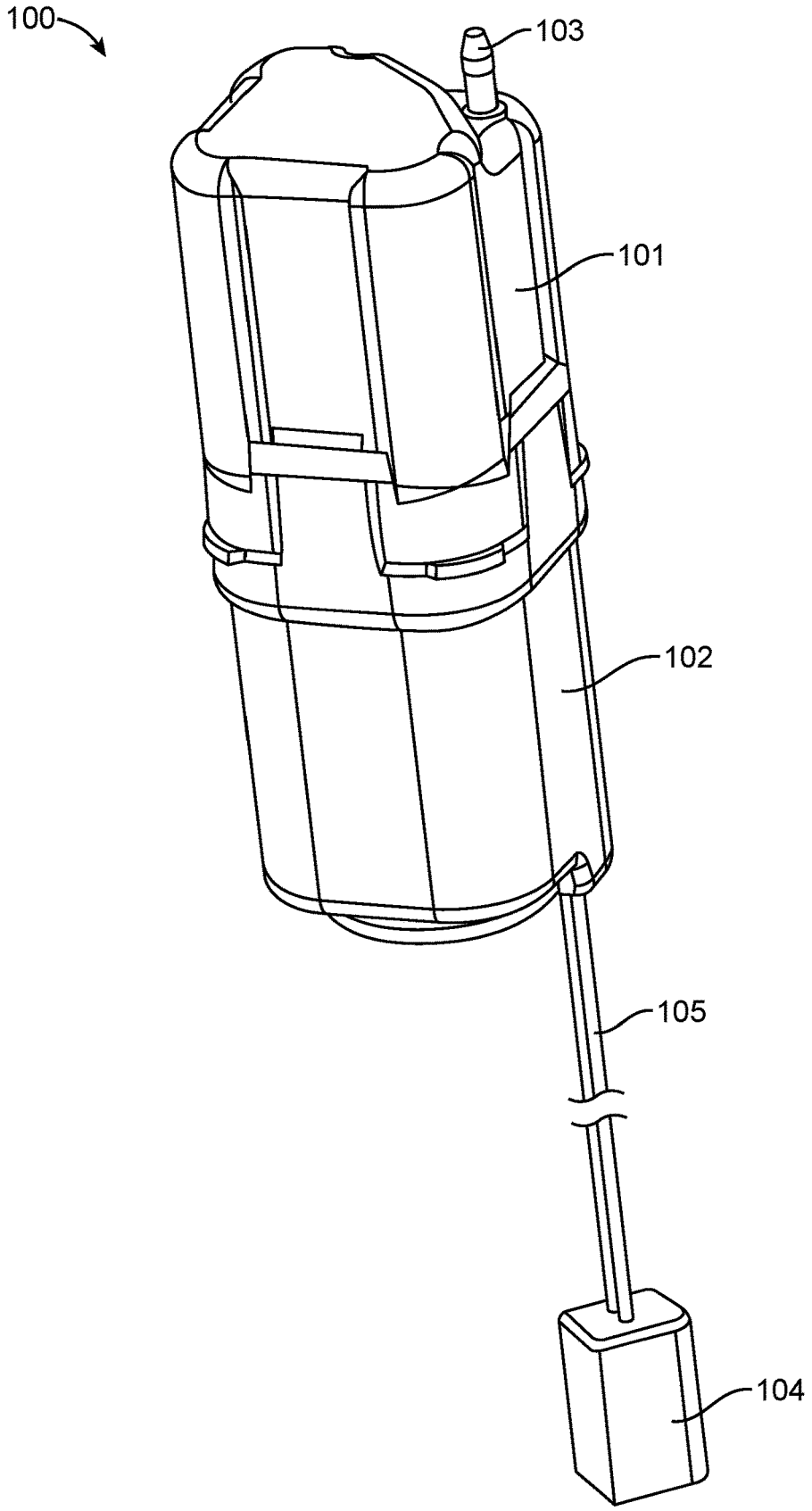
FIG. 1 is a perspective view of an embodiment of a pump assembly according to the present disclosure.

FIG. 1 illustrates a pump assembly 100 including a first or upper casing 101 and a second or lower casing 102. In an embodiment, the pump assembly 100 is configured for providing air for use in an application, for example, in an automotive application. Such air may be provided from the pump assembly 100 through an upper casing outlet 103. The pump assembly 100 may include a pump configured to run (i.e., pump air through the upper casing outlet 103) using an electrical connection 105, which may supply electric power to the pump assembly 100. The electrical connection 105 may, through the use of a connector 104, be connected to a power source.

Figure 2:
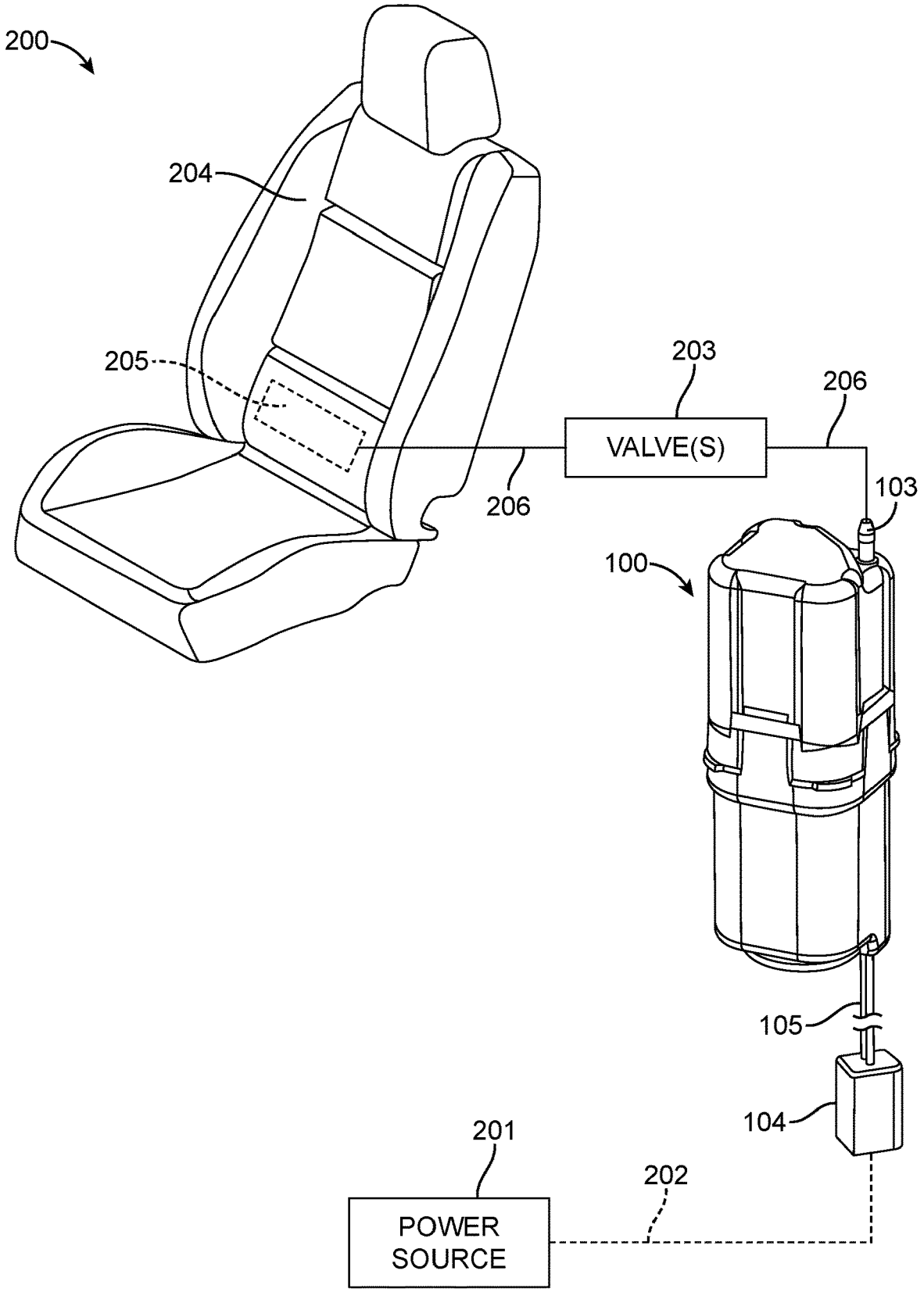
FIG. 2 is a schematic illustration of a pneumatic system according to the present disclosure, including the pump assembly of FIG. 1.

FIG. 2 illustrates an embodiment of a pneumatic system 200 including the pump assembly 100. The pneumatic system 200 may be a portion of an automobile. For example, in the illustrated embodiment, the pneumatic system 200 is part of an automobile seating assembly. Other applications of the pneumatic system 200 are contemplated, however, such as aerospace applications, office/desk chair applications, or the like.

In the illustrated embodiment, the pneumatic system 200 includes a power source 201, which may be part of an electrical power system of an automobile. The connector 104 is configured to connect to the power source 201. As such, the power source 201 may supply power 202 (e.g., at 12 Volts or 24 Volts in some embodiments) through the electrical connection 105 and to the pump assembly 100 via the connector 104.

When the pump assembly 100 is powered, the pump assembly 100 may operate to pump air through the upper casing outlet 103. Air may flow from the upper casing outlet 103 through a pneumatic line 206. The pneumatic line 206 may include valves 203 along or at either end of the pneumatic line 206. The valves 203 may be a single valve and/or may be multiple valves, and, in either case, may serve to: (i) direct air along the pneumatic line 206 from the pump assembly 100, (ii) stop an airflow along the pneumatic line 206 directed from the pump assembly 100, (iii) regulate pressure of an airflow through the pneumatic line 206, and/or (iv) regulate flow rate of an airflow through the pneumatic line 206. Additionally or alternatively, the valves 203 may include a release valve, which may allow air to vent from the pneumatic line 206 to the atmosphere or into another, connected pneumatic line.

The pneumatic line 206 may be connected to one or more bladders 205. The bladder 205 may be configured to expand or contract as air from the pneumatic line 206 flows into or is removed from the bladder 205. In an embodiment, the bladder 205 may be supported in a bladder supporting device 204. In some embodiments, the bladder supporting device 204 is a seat configured to be positioned within an automobile. In an embodiment, the bladder 205 may be positioned within the bladder supporting device 204 to provide lumbar support when a user sits against the bladder supporting device 204. In such an embodiment, the user may provide a request for increasing or decreasing lumbar support (e.g., the user may press a button) which may activate the pump assembly 100 to provide air from the pump assembly 100, through the pneumatic line 206, and into the bladder 205 positioned within the bladder supporting device 204, thereby inflating the bladder 205 and providing the requested lumber support.

Figure 3:
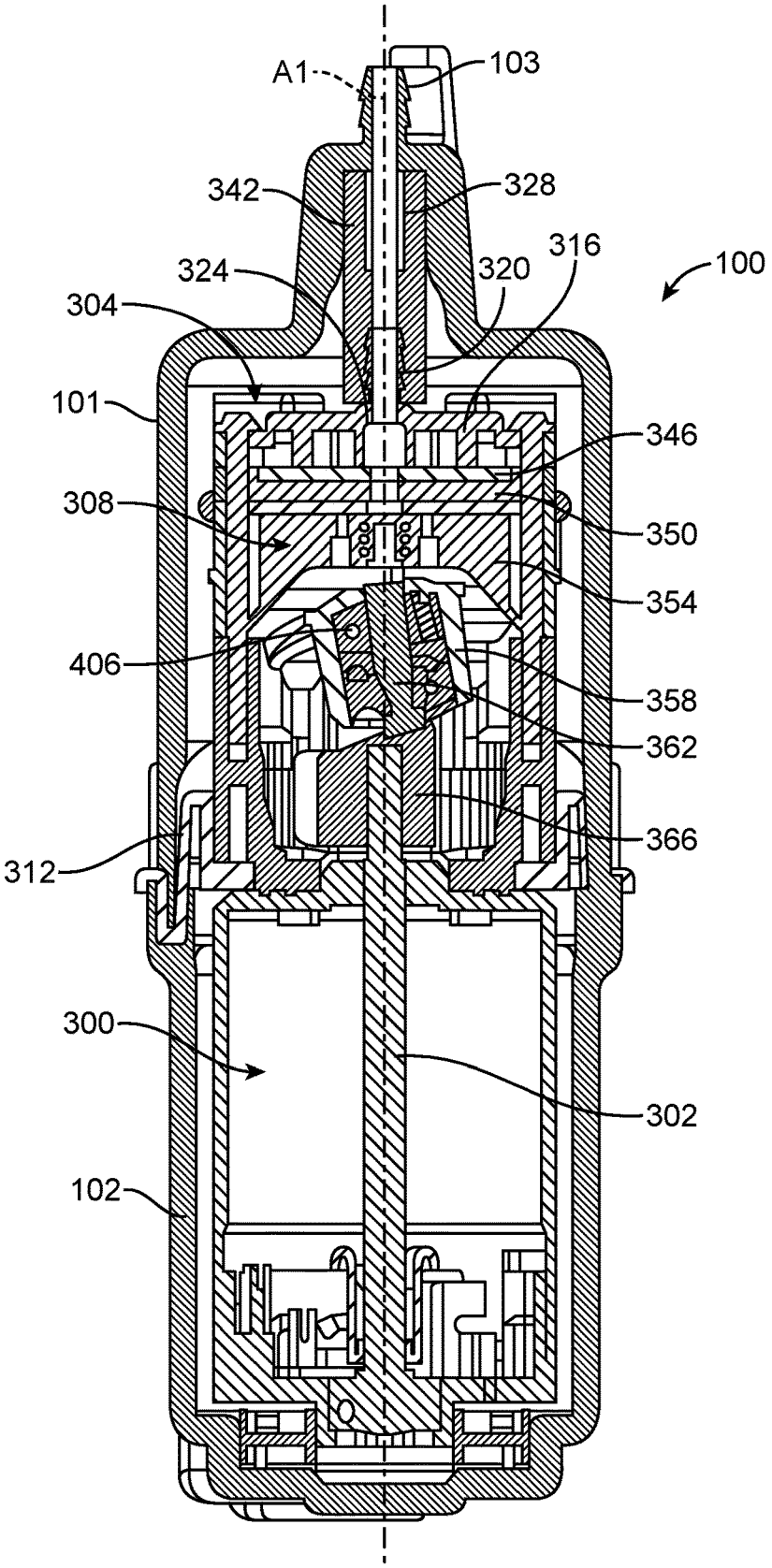
FIG. 3 is a cross-sectional view illustrating a pump assembly according to the present disclosure.
Figure 4:
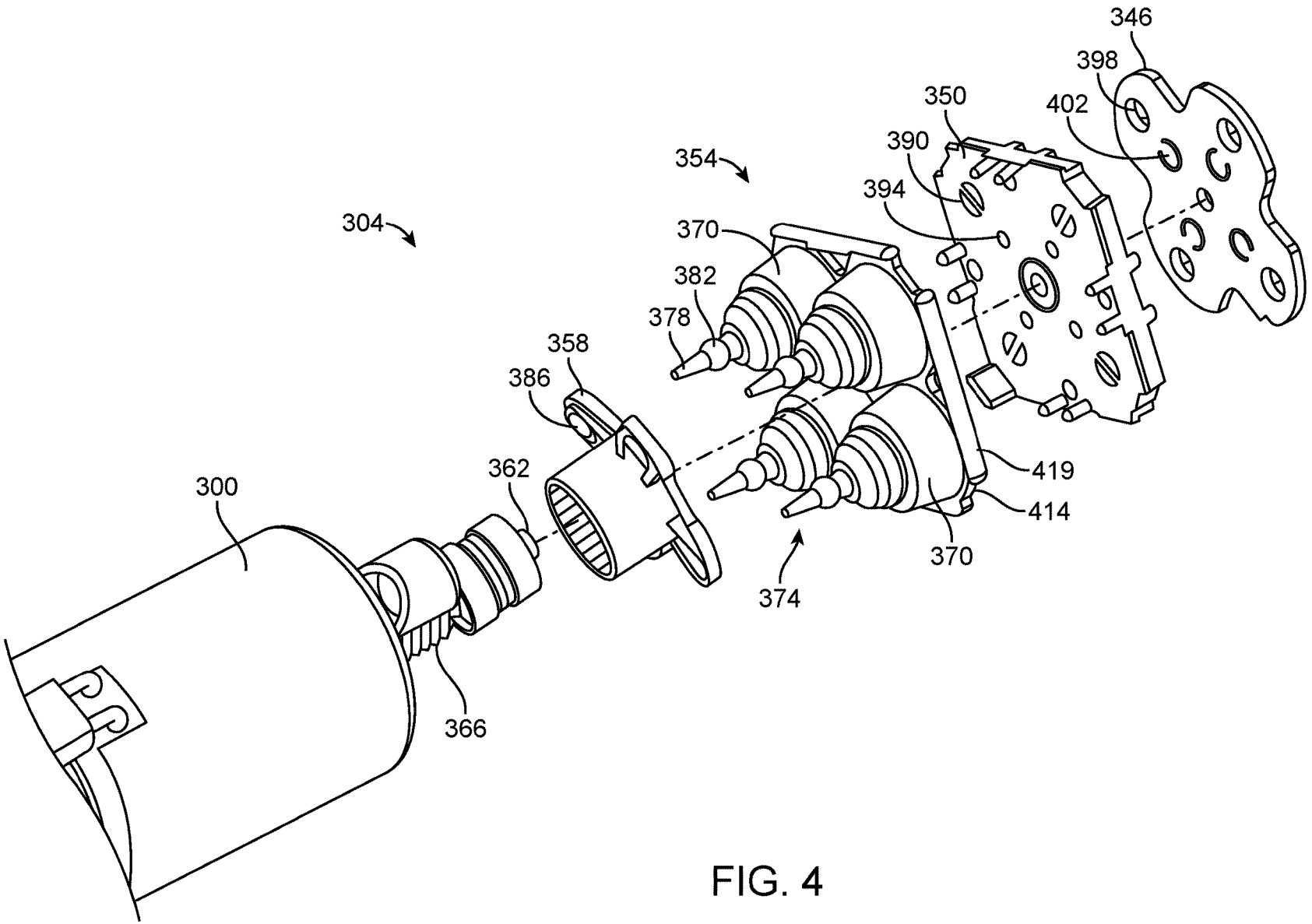
FIG. 4 is an exploded view of a portion of the pump assembly of FIG. 3.

Referring now to FIGS. 3-4, the pump assembly 100, as previously mentioned, includes the upper casing 101 and the lower casing 102 connected to the upper casing 101. An electric motor 300 is disposed at least partially within the lower casing 102. An upper pump assembly 304 including a pneumatic pump 308 is disposed at least partially within the upper casing 101. As such, the upper casing 101 and the lower casing 102 cooperate to enclose the electric motor 300 and the pneumatic pump 308.

A seal 312 (FIG. 3) is positioned between the upper casing 101 and the lower casing 102. The seal 312 is made of a flexible material, such as rubber, silicone, or other resilient elastomeric materials, or the like. The seal 312 couples the upper casing 101 and the lower casing 102 and, in some embodiments, may provide a vibration damping connection between the upper casing 101 and the lower casing 102.

Referring again to FIG. 3, the upper pump assembly 304 includes an outlet plate 316 and an outlet plate fitting 320 that extends from the outlet plate 316 along a central axis A1 of the pump assembly 304. An outlet plate discharge passage 324 extends through the outlet plate 316 and the outlet plate fitting 320 and provides an outlet for air to exit the upper pump assembly 304.

The upper casing outlet 103 is positioned at an end of the upper casing 101 and, in the illustrated embodiment, includes an inner fitting 328 extending from an interior side of the upper casing 101. A tube 342 interconnects the outlet plate fitting 320 and the inner fitting 328 such that air pumped by the pneumatic pump 308 may flow from the outlet plate discharge passage 324 to the upper casing outlet 103 via the tube 342.

Referring now to FIG. 4, the upper pump assembly 304 further includes a valve plate 346, a head plate 350, a diaphragm assembly 354, a wobble plate 358, an eccentric shaft 362, and a crank 366. The illustrated diaphragm assembly 354 includes a plurality of cup-shaped diaphragms 370 and associated plungers 374, each plunger 374 extending from a lower center portion of its associated diaphragm 370. Each plunger 374 includes a stem portion 378 that extends through the wobble plate 358 and a bead 382 formed on the stem portion 378 and having a larger diameter than the remainder of the stem portion 378. During assembly, the bead 382 of each plunger 374 is compressed and inserted through a corresponding bore 386 in the wobble plate 358. The bore 386 has a smaller diameter than the bead 382 so as to retain the stem portions 378 of the plungers 374 within the wobble plate 358. As described in greater detail below, movement of the wobble plate 358 causes the plungers 374 to reciprocate, thereby compressing and expanding the diaphragms 370. In the illustrated embodiment, the diaphragm assembly 354 includes four diaphragms 370 and plungers 374; however, the diaphragm assembly 354 may include one, two, three, five, or any other number of diaphragms 370 and plungers 374 in other embodiments.

The wobble plate 358 is rotatably supported on the eccentric shaft 362 by bearings 406. The eccentric shaft 362 is eccentrically mounted on the crank 366, which in turn is coupled for co-rotation with an output shaft 302 of the electric motor 300. As such, the electric motor 300 rotates the crank 366 which, in turn, rotates the eccentric shaft 362. The eccentric shaft 362 is oriented and positioned such that rotation of the eccentric shaft 362 imparts a wobbling motion on the wobble plate 358. More particularly, each corner of the wobble plate 358 is sequentially moved up and down, in a direction generally parallel to the central axis A1, which imparts reciprocating (i.e., up and down) motion to the plungers 374 of the diaphragm assembly 354.

With continued reference to FIG. 4, the head plate 350 includes an inlet opening 390 and an outlet opening 394 in fluid communication with an interior volume or compression chamber of each respective diaphragm 370. The valve plate 346 overlies the head plate 350 and includes a one-way inlet valve 398 in fluid communication with the inlet opening 390 and a one-way outlet valve 402 in fluid communication with the outlet opening 394. The inlet and outlet valves 398, 402 are configured as reed valves in the illustrated embodiment and are integrally formed with the valve plate 346. In other embodiments, other types of one-way valves may be used.

In operation, as each plunger 374 is moved up, the interior volume of the associated cup-shaped diaphragm 370 is compressed. As the interior volume is compressed, air is expelled from the diaphragm 370, out through the associated outlet opening 394 in the head plate 350 and the outlet valve 402 in the valve plate 346. The expelled air is routed into the outlet plate 316, and ultimately discharged through the upper casing outlet 103. As each plunger 374 is moved back downward, the interior volume of the associated diaphragm 370 expands, which draws air into the interior volume of the diaphragm 370 through the associated inlet opening 390 and inlet valve 398.

Figure 5:
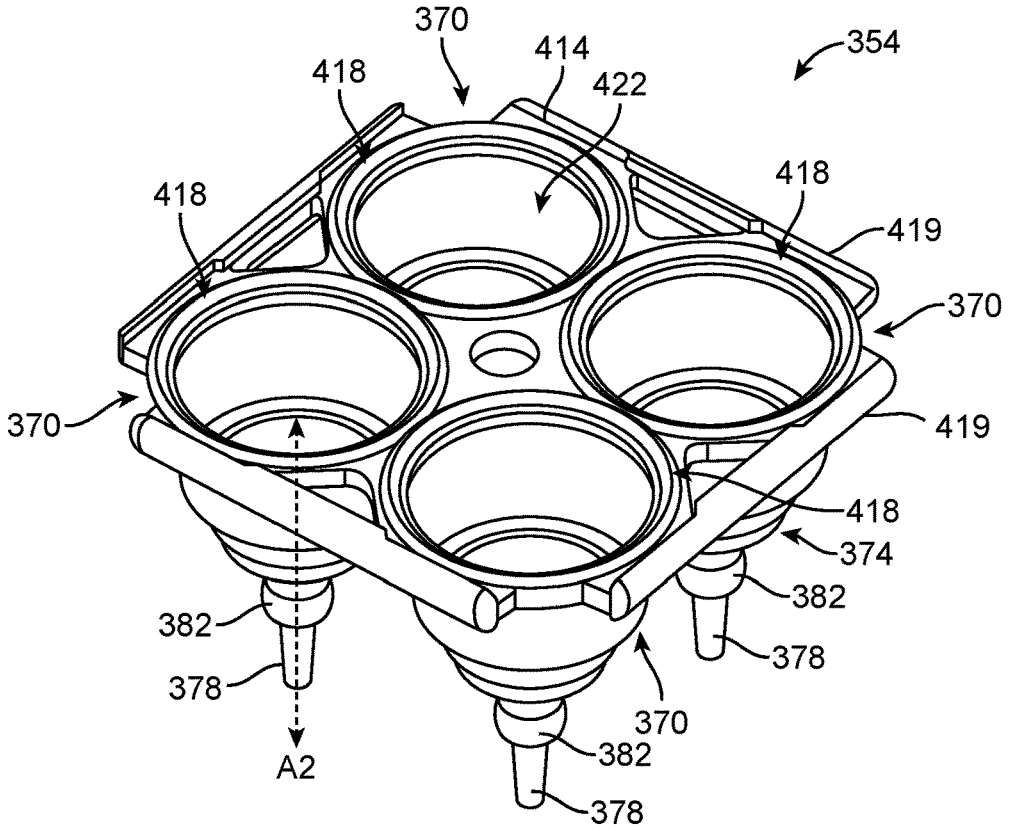
FIG. 5 is an upper perspective view of a diaphragm assembly of the pump assembly of FIG. 3.
Figure 6:
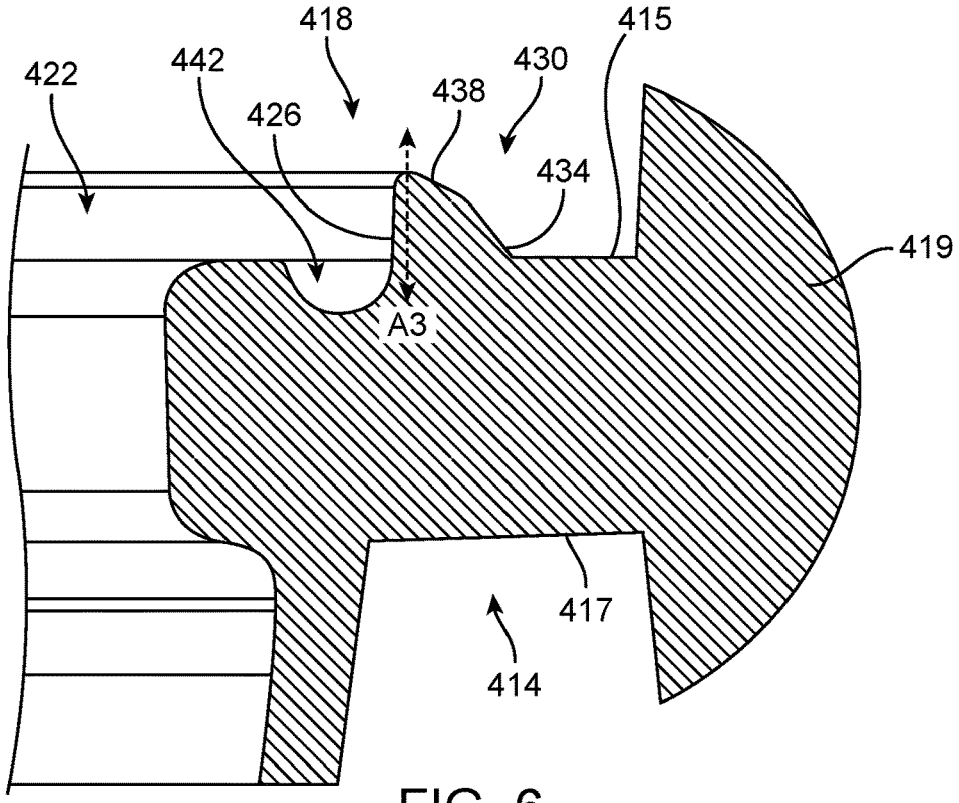
FIG. 6 is a partial cross-sectional view of the diaphragm of FIG. 5.

With reference to FIGS. 5-6 the illustrated diaphragm assembly 354 includes a flange 414 generally surrounding the diaphragms 370 and having a flange upper surface 415 and a flange lower surface 417 (FIG. 6). The flange upper surface 415 and the flange lower surface 417 are parallel and planar in the illustrated embodiment. A rim 419 extends from an outer end of the flange 414. In the illustrated embodiment, the rim 419 comprises multiple (e.g., four) segments (FIG. 5); however, the rim 419 may be a continuous rim surrounding the flange 414 in other embodiments.

With continued reference to FIGS. 5-6, each diaphragm 370 in the illustrated embodiment includes a diaphragm seal 418 surrounding an opening 422 of the diaphragm 370. The seal 418 extends upwardly from the flange upper surface 415 in a direction towards the head plate 350 and is configured to engage and seal against a bottom side of the head plate 350. Each diaphragm opening 422 is aligned with a corresponding pair of inlet and outlet openings 390, 394 of the head plate 350 (FIG. 4). The illustrated diaphragm openings 422 are circular in a plane perpendicular to a reciprocation axis A2 of the plunger 374; however the shape of the openings 422 may vary in other embodiments.

The diaphragm seal 418 extends around a perimeter of each opening 422 to surround the opening 422 and to seal each diaphragm 370 against the head plate 350. Therefore, as the diaphragm 370 is cyclically compressed and expanded, the air must flow through outlet opening 394 and the inlet opening 390, respectively. That is, the seals 418 inhibit air from entering or escaping at the interface between the diaphragm assembly 354 and the head plate 350. In some embodiments, as illustrated in FIGS. 5-11, the diaphragm assembly 354, including the diaphragms 370, flange 414, rim 419, and diaphragm seals 418, may be integrally formed as a single, molded component and from a moldable, resilient material, such as an elastomeric material.

FIG. 6 illustrates a first embodiment of the diaphragm seal 418 that may be incorporated into the diaphragm assembly 354. The diaphragm seal 418 illustrated in FIG. 6 includes a radially inner side 426 and a radially outer side 430. The radially outer side 430 forms a sealing surface that engages the head plate 350 to seal the diaphragm 370 to the head plate 350. The radially outer side 430 extends from the upper surface 415 of the flange 414 at an oblique angle. The orientation of the radially outer side 430 may also be defined by an oblique angle measured between the radially outer side 430 and a vertical axis A3 extending perpendicular to the upper surface 415 of the flange 414 (i.e., parallel to the reciprocation axis A2 of the plunger 374). In the illustrated embodiment, the radially outer side 430 extends inwardly towards the interior volume of the diaphragm 370. Therefore, the radially outer side 430 (i.e., the sealing surface) is inclined from the upper flange surface 415 toward a center of the opening 422 of the diaphragm 370.

In the illustrated embodiment, the radially outer side 430 includes a base portion 434 and a sealing portion 438. The base portion 434 extends from the upper surface 415 of the flange 414 at a first oblique angle, and the sealing portion 438 extends from the base portion 434 at a second oblique angle that is different than the first oblique angle. In the illustrated embodiment, the second oblique angle is greater than the first oblique angle. However, in other embodiments, the second oblique angle may be less than or equal to the first oblique angle.

With continued reference to FIG. 6, the radially inner side 426 of the diaphragm seal 418 extends from the flange 414 to converge with the radially outer side 430. Thus, the diaphragm seal 418 is generally triangular or "fin-shaped" in cross-section. In some embodiments, the radially inner side 426 extends from the upper surface 415 of the flange 414 at an oblique angle. In other embodiments, the radially inner side 426 may extend perpendicularly from the flange 414. The illustrated diaphragm seal 418 is widest at a portion extending from the flange 414 and tapers towards a portion that engages the head plate 350. Unlike the radially outer side 430, the radially inner side 426 extends at a constant angle (i.e., does not have distinct base and seal portions). However, in other embodiments, the radially inner side 426 may include multiple portions similar to the radially outer side 430.

In the illustrated embodiment, a recess 442 is formed in the upper surface 415 of the flange 414 radially inward of and adjacent to the radially inner side 426 of the diaphragm seal 418. The recess 442 extends around the opening 422 of the diaphragm 370 and forms a groove within the flange 414. In the illustrated embodiment, the recess 442 is generally semi-circular in cross-sectional shape and is contiguous with the radially inner side 426 of the diaphragm seal 418. The recess 442 provides a relief for the diaphragm seal 418 to deform radially inwardly as the diaphragm seal 418 engages the head plate 350.

When assembled, the head plate 350 compresses the outer side 430 of the seal 418 such that the diaphragm seal 418 is deformed inwardly towards the interior volume of the diaphragm 370. Specifically, the sealing portion 438 of the radially outer side 430 engages the head plate 350, and the diaphragm seal 418 deforms radially inwardly.

The cooperating geometries of the inclined outer side 430 of seal 418 and the recess 442, which allow for the inward compression of seal 418, provide an enhanced sealing area between the head plate 350 and diaphragm 370. This increased sealing contact performance between the head plate 350 and diaphragm 370 has been found to improve the ability of seal 418 to accommodate dimensional changes to the pump assembly 304, for example, due to thermal expansion of components of the pump assembly 304, as well as larger discrepancies in the size and shape of the pump components (e.g., due to manufacturing tolerances) while maintaining the necessary seal.

Figure 7:
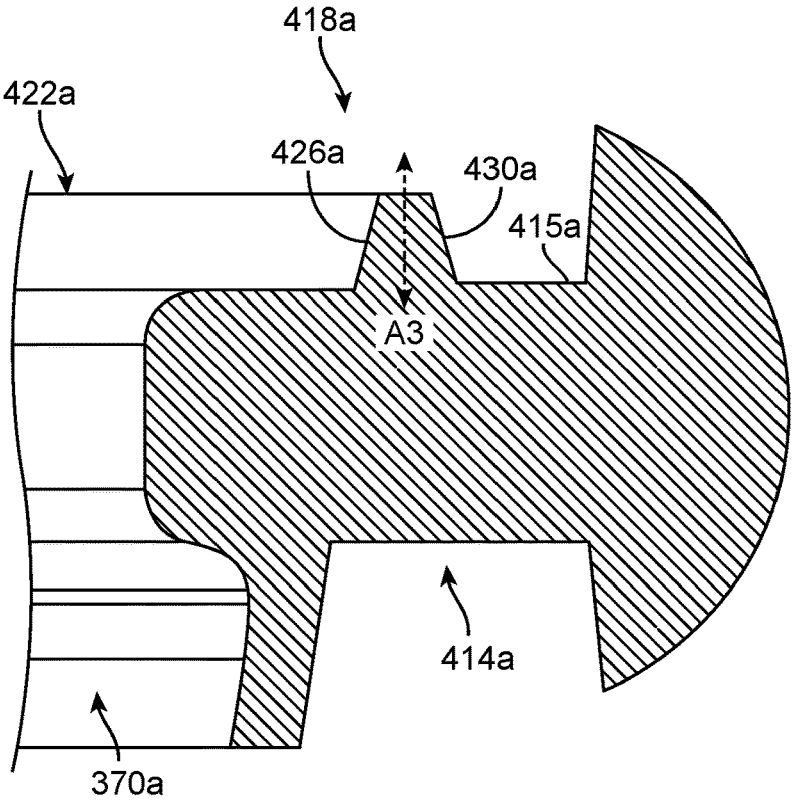
FIG. 7 is a partial cross-sectional view of a diaphragm according to another embodiment of the present disclosure.

FIG. 7 illustrates a diaphragm seal 418*a* in accordance with another embodiment of the present disclosure and that may be incorporated into the diaphragm assembly 354. The diaphragm seal 418*a* is similar to the above-described diaphragm seal 418, with like parts having like reference numerals plus the letter "a" appended thereon and the following differences explained below.

The radially outer side 430*a* of the diaphragm seal 418*a* is formed of a single surface extending from the upper surface 415*a* of the flange 414*a* at an oblique angle inwardly towards the interior volume of the diaphragm 370*a*. The radially inner side 426*a* of the diaphragm seal 418*a* is also a single surface extending at an oblique angle from the flange 414*a*. The radially inner side 426*a* and the radially outer side 430*a* are angled such that the diaphragm seal 418*a* tapers in a direction away from the flange 414*a*. The diaphragm seal 418*a* forms a generally trapezoidal shape in cross-section. In the illustrated embodiment, the radially inner side 426*a* and the radially outer side 430*a* extend at angles that are equal in magnitude and bisected by the vertical axis A3 of the diaphragm seal 418*a*. However, in other embodiments, the radially inner side 426*a* and the radially outer side 430*a* may extend at different angles (e.g., non-equal in magnitude). Furthermore, in the illustrated embodiment, the flange 414*a* does not include a recess disposed adjacent to the diaphragm seal 418*a*; however, a recess similar to the recess 442 may be included in other embodiments.

Figure 8:
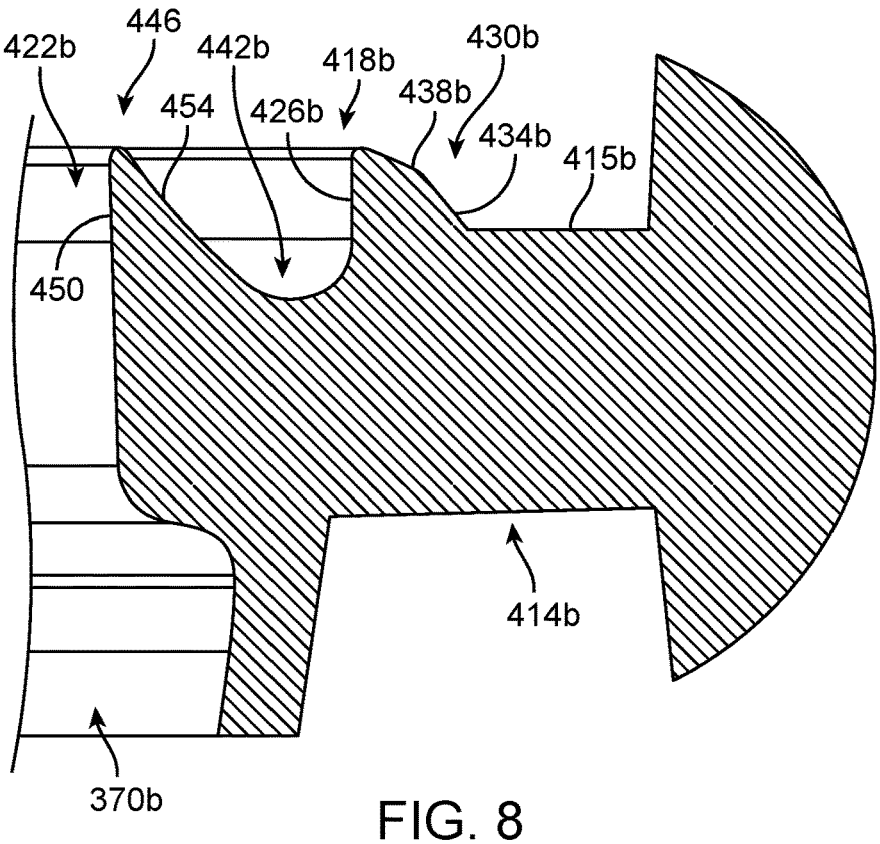
FIG. 8 is a partial cross-sectional view of a diaphragm according to yet another embodiment of the present disclosure.

FIG. 8 illustrates a diaphragm seal 418*b* in accordance with yet another embodiment of the present disclosure and that may be incorporated into the diaphragm assembly 354. The diaphragm seal 418*b* is similar to the above-described diaphragm seal 418 with like parts having like reference numerals plus the letter "b" appended thereon and the following differences explained below.

The diaphragm seal 418*b* is a radially outer seal, and the diaphragm 370*b* further includes a radially inner seal 446 offset from the radially outer seal 418*b*. In the illustrated embodiment, the recess 442*b* is disposed between the radially inner seal 446 and the radially outer seal 418*b*, and the radially inner and outer seals 446, 418*b* are asymmetrical about the recess 442*b*. The radially inner seal 446 includes an inner surface 450 and an outer surface 454. The inner surface 450 is oriented vertically or parallel to the reciprocation axis A2 of the plunger 374. The outer surface 454 is oriented at an oblique angle relative to the reciprocation axis A2 (FIG. 5) and extends from the recess 442*b* in a direction towards the inner surface 450. In some embodiments, the outer surface 454 intersects with the recess 442*b* at a point at which the outer surface 454 is tangent to the recess 442*b*. Thus, the radially inner seal 446 is generally triangular in cross-sectional shape and tapers in a direction away from the flange 414*b*.

Figure 9:
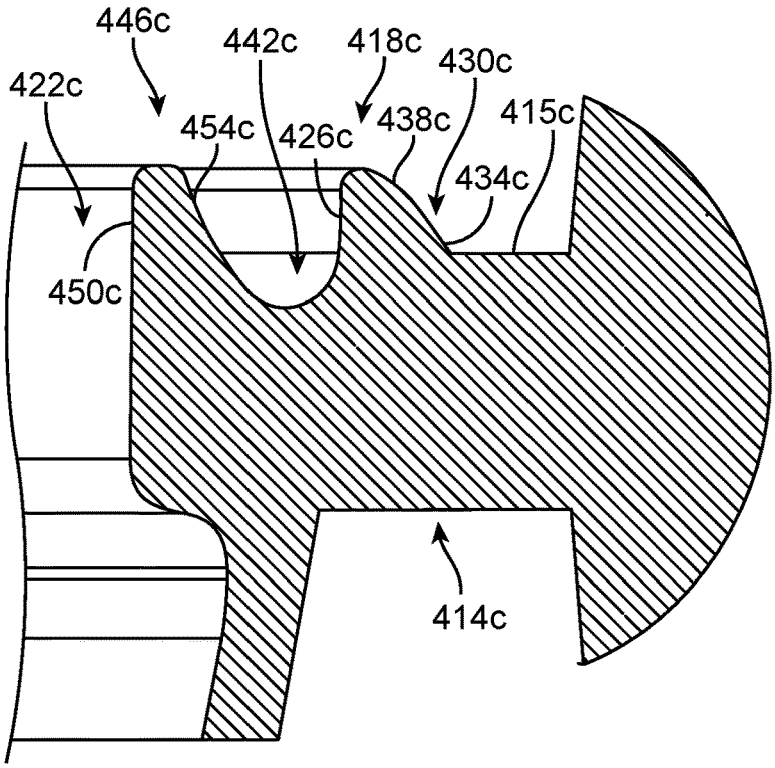
FIG. 9 is a partial cross-sectional view of a diaphragm according to yet another embodiment of the present disclosure.

FIG. 9 illustrates a diaphragm seal 418*c* in accordance with yet another embodiment of the present disclosure and that may be incorporated into the diaphragm assembly 354. The diaphragm seal 418*c* is similar to the above-described diaphragm seal 418 with like parts having like reference numerals plus the letter "c" appended thereon and the following differences explained below.

The diaphragm seal 418*c* is similar to the diaphragm seal 418*b* of FIG. 8. However, each of the radially outer seal 418*c* and the radially inner seal 446*c* are truncated, thereby providing the outer seal 418*c* and the inner seal 446*c* with a wider peak compared to the outer seal 418*b* and inner seal 446.

Figure 10:
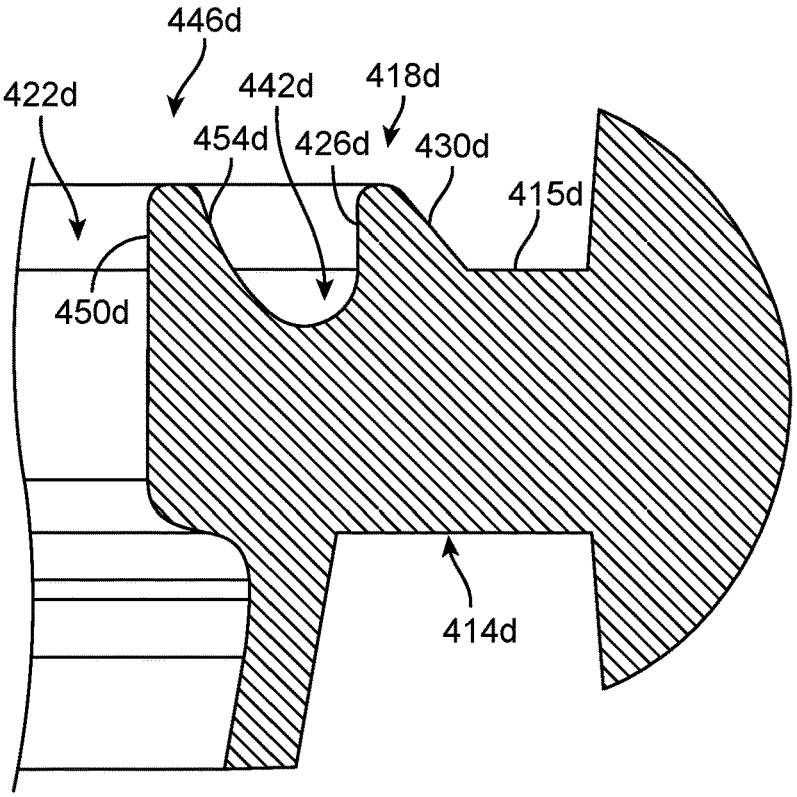
FIG. 10 is a partial cross-sectional view of a diaphragm according to yet another embodiment of the present disclosure.

FIG. 10 illustrates a diaphragm seal 418*d* in accordance with yet another embodiment of the present disclosure and that may be incorporated into the diaphragm assembly 354. The diaphragm seal 418*d* is similar to the above-described diaphragm seal 418 with like parts having like reference numerals plus the letter "d" appended thereon and the following differences explained below.

The diaphragm seal 418*d* is similar to the diaphragm seal 418*c* of FIG. 9. However, the radially outer side 430*d* of the outer seal 418*d* includes a single, flat surface, rather than a base surface and a sealing surface forming distinct oblique angles.

Figure 11:
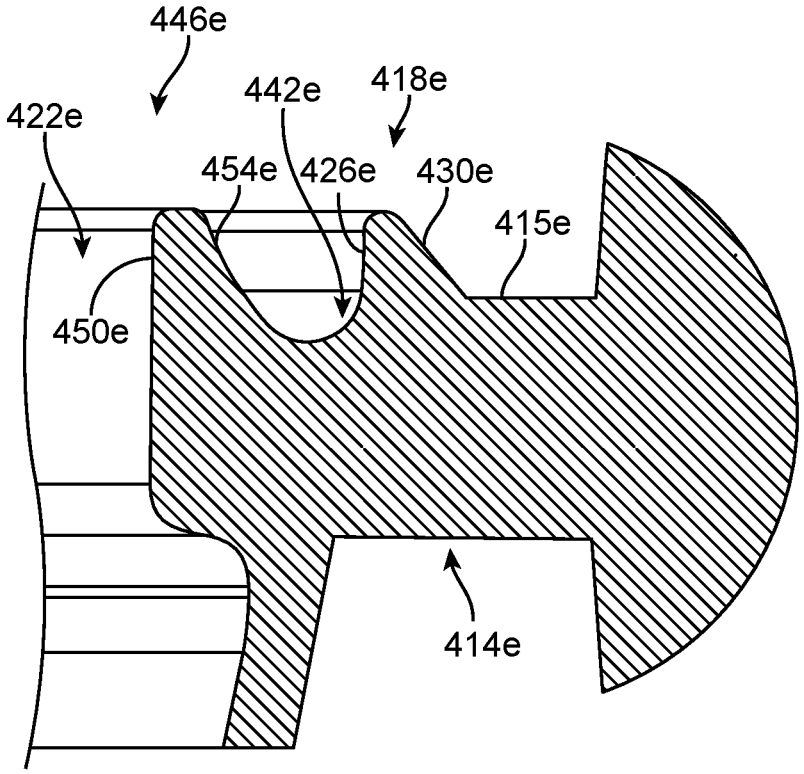
FIG. 11 is a partial cross-sectional view of a diaphragm according to yet another embodiment of the present disclosure.

FIG. 11 illustrates a diaphragm seal 418*e* in accordance with yet another embodiment of the present disclosure and that may be incorporated into the diaphragm assembly 354. The diaphragm seal 418*e* is similar to the above-described diaphragm seal 418 with like parts having like reference numerals plus the letter "e" appended thereon and the following differences explained below.

The diaphragm seal 418*e* is similar to the diaphragm seal 418*d*; however, the diaphragm seal 418*e* includes a larger recess 442*e* disposed between the radially inner seal 446*e* and the radially outer seal 418*e*.

Each of the diaphragm seals 418-418*e* described and illustrated herein includes, among other things, an angled radially outer side 430-430*e* that converges toward the center of the opening 422-422*e* of the associated diaphragm 370. As such, when the diaphragm assembly 354 is coupled to the head plate 350 (FIG. 4), the radially outer side

430-430*e* is compressed against the head plate 350 and bends inwardly to form a wider sealing surface against the head plate 350, thereby improving sealing performance (e.g., improving the airtightness of the seal 418-418*e*).

In some embodiments, such as those illustrated in FIGS. 8-11, providing a radially inner seal 446*c*-446*e* provides redundancy to further improve sealing performance. By providing two seals 418*c*-418*e*, 446*c*-446*e*, the total sealing surface contact area with the head plate 350 is increased to inhibit air leakage. The seals 446*c*-446*e*, 418*c*-418*e* may also be optimized for performance at different pressure ranges. For example, in some embodiments, the geometry of the inner seal 446*c*-446*e* may result in the inner seal 446*c*-446*e* being more flexible than the outer seal 418*c*-418*e*. The flexibility of the inner seal 446*c*-446*e* may improve sealing performance at lower pressures but may result in leaks at higher pressures. The reduced flexibility of the outer seal 418*c*-418*e* may improve sealing performance at higher pressures to provide a backup seal if air escapes past the inner seal 446*c*-*e*.

Although the present disclosure has been described in detail with reference to certain preferred embodiments, variations and modifications exist within the scope and spirit of one or more independent aspects of the disclosure as described.

Various features and aspects of the present disclosure are set forth in the following claims.

What is claimed is:

1. A diaphragm for use with a pump assembly, the diaphragm comprising:

a flange;

a cup-shaped wall extending from the flange and defining an interior volume having an opening;

a plunger extending from the cup-shaped wall, the plunger configured to be reciprocated by the pump assembly to move the cup-shaped wall, thereby cyclically compressing and expanding the interior volume;

a seal extending from an upper surface of the flange such that the seal surrounds the opening, the seal including an outer sealing surface configured to engage a portion of the pump assembly; and a recess in an upper surface of the flange surrounding the opening, wherein the recess is positioned radially inward from and adjacent to an inner surface of the seal, wherein the outer sealing surface extends from the flange at an oblique angle such that the outer sealing surface is inclined from the upper surface of the flange toward a center of the opening.

2. The diaphragm of claim 1, wherein the diaphragm is integrally formed as a single, molded component.

3. The diaphragm of claim 1, wherein the seal is an outer seal, the diaphragm further comprising an inner seal extending from the flange and spaced radially inwardly from the outer seal.

4. The diaphragm of claim 3, wherein the recess extending into the flange is positioned between the inner seal and the outer seal.

5. The diaphragm of claim 3, wherein the inner seal has a first cross-sectional shape, and wherein the outer seal has a second cross-sectional shape that is different than the first cross-sectional shape.

6. The diaphragm of claim 5, wherein the outer seal is configured to withstand a greater pressure than the inner seal.

7. A pump assembly comprising:

a diaphragm including a wall defining an interior volume having an opening, a plunger coupled to the wall, an inner seal surrounding and extending from a perimeter of the opening, and an outer seal surrounding and spaced apart from the inner seal;

a plate coupled to the diaphragm opposite the plunger; and a drive mechanism configured to reciprocate the plunger along a reciprocation axis to perform cycles of compressing and expanding the interior volume, wherein the inner seal and the outer seal engage the plate to inhibit air from entering or escaping the interior volume through an interface between the diaphragm and the plate, and wherein the inner seal, the outer seal, and the opening are concentric with the reciprocation axis.

8. The pump assembly of claim 7, further comprising a recess formed between the inner seal and the outer seal.

9. The pump assembly of claim 7, wherein the inner seal tapers in a direction from the diaphragm towards the plate.

10. The pump assembly of claim 7, wherein the outer seal tapers in a direction from the diaphragm towards the plate.

11. The pump assembly of claim 7, wherein the inner seal has a first cross-sectional shape, and wherein the outer seal has a second cross-sectional shape that is different than the first cross-sectional shape.

12. The pump assembly of claim 7, wherein the diaphragm is a first diaphragm of a plurality of diaphragms.

13. The pump assembly of claim 7, wherein the inner seal is more flexible than the outer seal.

14. The pump assembly of claim 7, wherein the inner seal has an inner wall and an outer wall, wherein the inner wall is parallel to an axis of reciprocation of the plunger, and wherein the outer wall is sloped relative to the inner wall.

15. The pump assembly of claim 7, wherein the outer seal has an inner wall and an outer wall, wherein the inner wall is parallel to the reciprocation axis, and wherein the outer wall is sloped towards the inner wall.

16. A pump assembly comprising:

a diaphragm assembly including a plurality of diaphragms, each diaphragm of the plurality of diaphragms including:

a wall defining an interior volume having an opening, a plunger coupled to the wall, an inner seal surrounding and extending from a perimeter of the opening, and an outer seal surrounding and spaced apart from the inner seal;

a plate coupled to the diaphragm assembly; and a drive mechanism configured to reciprocate the plunger of each diaphragm of the plurality of diaphragms to perform cycles of compressing and expanding the interior volume, wherein the inner seal and the outer seal of each diaphragm of the plurality of diaphragms engage the plate to inhibit air from entering or escaping the interior volume through an interface between the diaphragm and the plate.

17. The pump assembly of claim 16, wherein the diaphragm assembly is integrally molded as a single component.

18. The pump assembly of claim 16, wherein the drive mechanism is configured to reciprocate each diaphragm of the plurality of diaphragms sequentially.

19. The pump assembly of claim 16, wherein the inner seal has a first cross-sectional shape, and wherein the outer seal has a second cross-sectional shape that is different than the first cross-sectional shape.

20. The pump assembly of claim 17, wherein the inner seal and the outer seal each includes an obliquely oriented outer surface.

* * * * *